US009644153B2

(12) United States Patent
Daywalt

(10) Patent No.: US 9,644,153 B2
(45) Date of Patent: May 9, 2017

(54) VAPOR PRESSURE ENHANCER

(71) Applicant: Clark Lester Daywalt, Tulsa, OK (US)

(72) Inventor: Clark Lester Daywalt, Tulsa, OK (US)

( * ) Notice: Subject to any disclaimer, the term of this patent is extended or adjusted under 35 U.S.C. 154(b) by 485 days.

(21) Appl. No.: 14/272,829

(22) Filed: May 8, 2014

(65) Prior Publication Data

US 2015/0322354 A1 Nov. 12, 2015

(51) Int. Cl.

| | |
|---|---|
| ***F02M 33/00*** | (2006.01) |
| ***C10G 11/02*** | (2006.01) |
| ***C10G 51/02*** | (2006.01) |

(52) U.S. Cl.

CPC ..... *C10G 11/02* (2013.01); *C10G 51/026* (2013.01); *Y10T 29/49346* (2015.01)

(58) Field of Classification Search

CPC .. C10G 11/02; C10G 51/026; Y10T 29/49346
USPC ..... 123/538
See application file for complete search history.

(56) References Cited

U.S. PATENT DOCUMENTS

| | | | | |
|---|---|---|---|---|
| 3,900,546 | A * | 8/1975 | Kaukeinen | B28B 3/206 264/102 |
| 4,121,543 | A | 10/1978 | Hicks et al. | |
| 4,303,051 | A | 12/1981 | Weishaar | |
| 4,832,837 | A | 5/1989 | Frederick et al. | |
| 5,048,499 | A | 9/1991 | Daywalt | |
| 5,197,446 | A | 3/1993 | Daywalt et al. | |
| 5,524,594 | A * | 6/1996 | D'Alessandro | F02M 27/02 123/538 |
| 5,881,702 | A | 3/1999 | Arkfeld | |
| 6,450,155 | B1 | 9/2002 | Arkfeld | |
| 7,156,081 | B2 | 1/2007 | Ratner et al. | |
| 7,428,896 | B2 | 9/2008 | Eriksson et al. | |
| 7,942,135 | B1 | 5/2011 | Daywalt | |
| 8,342,159 | B2 | 1/2013 | Detore | |
| 8,453,624 | B2 | 6/2013 | Selano | |
| 8,613,273 | B2 | 12/2013 | Ratner | |

* cited by examiner

*Primary Examiner* — Marguerite McMahon
(74) *Attorney, Agent, or Firm* — Molly McKay

(57) ABSTRACT

The present invention relates to a device that installs in-line in the fuel supply line of fuel usage equipment such as a HVAC system or a large commercial natural gas or diesel generator. The device is suitable for use with liquid or gas hydrocarbon fuels such as gasoline, diesel, propane, or natural gas. The device consists of a hollow cylinder with male ends and that contains a tightly packed copper wire core. The copper wire serves as a catalyst to crack the fuel's carbon chain molecules as the fuel flows through the device. The resulting fuel contains more and shorter fuel molecules, has a higher vapor pressure and burns more efficiently in the vehicle's engine. The copper wire is held in place by perforated copper keepers and the keepers are secured within the cylinder by snap rings that engage circumferential grooves provided internally at the ends of the cylinder.

1 Claim, 1 Drawing Sheet

VAPOR PRESSURE ENHANCER

BACKGROUND OF THE INVENTION

1. Field of the Invention

The present invention relates to a device that installs in the fuel line to fuel usage equipment such as a HVAC system or a large commercial natural gas or diesel generator. The invention functions to break the carbon chains of the carbon chain fuel molecules of liquid or gaseous hydrocarbon fuels so that the resulting shorter carbon molecules have a higher vapor pressure and burn more efficiently in the equipment. The device installs in a fuel supply line and consists of a hollow cylinder that contains tightly packed copper wire through which the fuel flows prior to being burned. The tightly packed copper wire is held in place in the cylinder by means of a perforated keeper that is retained by a snap ring that fits in a groove provided internally within the cylinder.

2. Description of the Related Art

Applicant's U.S. Pat. Nos. 5,048,499 and 5,197,446 each teach a vapor pressure enhancer and method for treating fuel. These patents teach a cylinder with a perforated core located inside the cylinder and the core having a central bore therethrough. One of these patents teaches that the core is formed of an alloy of copper, zinc, tin and nickel, and the other patent teaches a core formed of an alloy of copper, zinc, tin, nickel, and lead. In both inventions, the fuel passes through the cylinder and contacts the metallic core prior to being burned. Contact with the metallic core breaks the carbon chains of the fuel molecules so that the resulting shorter carbon molecules have a higher vapor pressure and burn more efficiently in the engine. The shortcoming of those prior inventions is that the core does not have enough surface area to contact with the fuel and the alloy does not work as well as a catalyst for breaking the carbon chains of the fuel molecules as desired. The teaching of those two prior patents is incorporated herein by reference.

Further, Applicant's U.S. Pat. No. 7,942,135 teaches a core of tightly packed copper wire. The copper wire is preferably pure copper wire, with no added metals. The increased surface area of the tightly packed copper wire core results in better contact with the fuel as it flows through the cylinder and the copper wire does a better job of breaking the carbon molecules than the alloys previously employed. The result is that the fuel burns more efficiently and the vehicle gets better gas mileage which saves fuel and money. However, this patent does not teach providing male ends on the cylinder so that it can be attached to a fuel line such as a natural gas fuel line. Also, this patent does not teach a means for holding the copper wire within the cylinder.

The present invention addresses these shortcomings by providing male ends on the cylinder and by providing a perforated copper keeper on each end of the cylinder to hold the copper wire in place within the cylinder. Each perforated copper keeper is secured in place by a snap ring that inserts into a circumferential groove proved internally within the hollow cylinder.

SUMMARY OF THE INVENTION

The present invention is a device that installs in the fuel line of fuel usage equipment such as a HVAC system or a large commercial natural gas or diesel generator. The device is designed for use with liquid or gas hydrocarbon fuels such as gasoline, diesel, propane, or natural gas and functions to break the carbon chains of the fuel molecules so that the resulting shorter carbon molecules have a higher vapor pressure and burn more efficiently. The device consists of a hollow cylinder that contains tightly packed copper wire through which the fuel flows prior to being burned. The cylinder is preferably provided with male threads at both of its ends so that it can be installed in-line in fuel usage equipment. Also, the packed copper wire is held within the cylinder by a perforated copper keeper on each end of the cylinder. Also, each perforated copper keeper is secured in place by a snap ring that inserts into a circumferential groove proved internally within the hollow cylinder.

DETAILED DESCRIPTION OF THE PREFERRED EMBODIMENT

Figure 1:
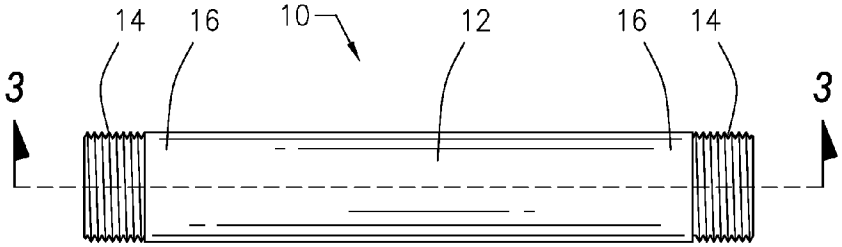
FIG. 1 is side view of a vapor pressure enhancer constructed in accordance with a preferred embodiment of the present invention as it would appear before being installed in-line in a fuel line supplying fuel to fuel usage equipment.
Figure 2:
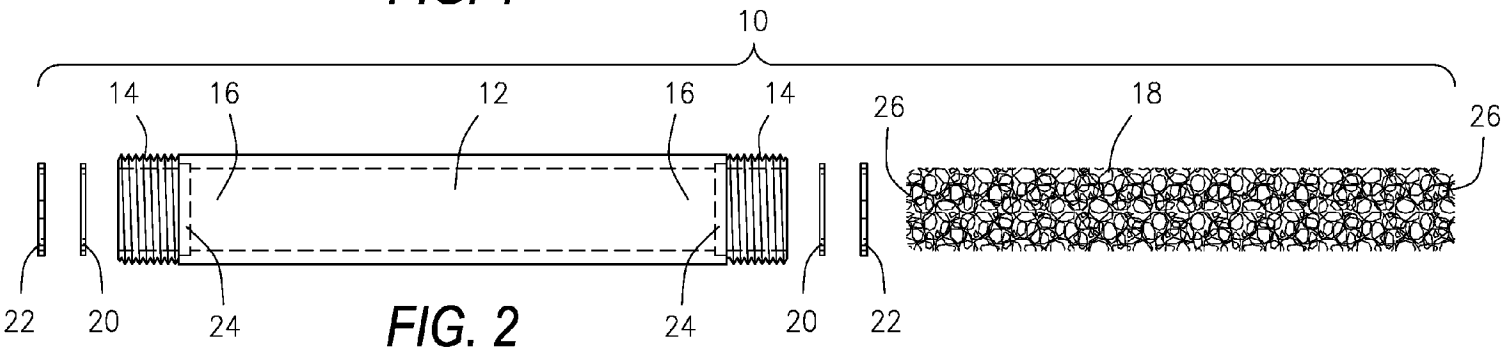
FIG. 2 is an exploded view of the vapor pressure enhancer of FIG. 1 showing the hollow cylinder, the tightly packed copper wire core that inserts into the hollow cylinder, two perforated copper keepers for holding the copper wire core within the cylinder, and two snap rings for retaining the keepers in place on either end of the cylinder.
Figure 3:
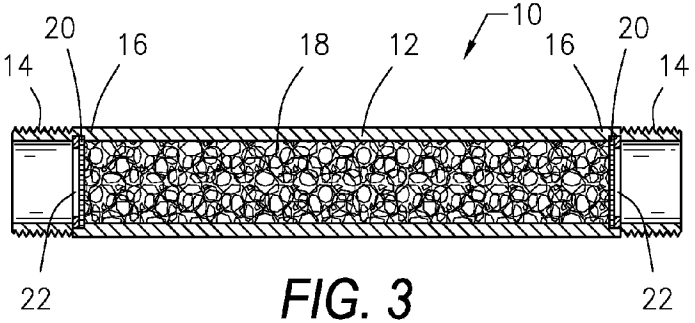
FIG. 3 is cross sectional view of the vapor pressure enhancer taken along line 3-3 of FIG. 1.

Referring now to the drawings and initially to FIGS. 1-3, there is illustrated a vapor pressure enhancer 10 constructed in accordance with a preferred embodiment of the present invention. FIG. 1 shows the vapor pressure enhancer 10 as it would appear before being installed in-line in a fuel line that supplies fuel to fuel usage equipment.

Referring also to FIGS. 2 and 3, the enhancer 10 includes a hollow tube or cylinder 12 that is provided with two male threaded ends 14 that are welded, machined into the cylinder or otherwise secured to each of the two ends 16 of the hollow cylinder 12. The cylinder 12 and the male threaded ends 14 are all preferably constructed of steel.

Figure 4:
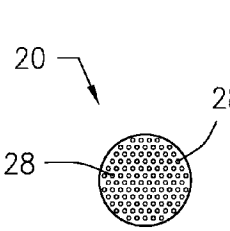
FIG. 4 is a top plan view of one of the keepers of FIG. 2 shown removed from the cylinder.
Figure 5:
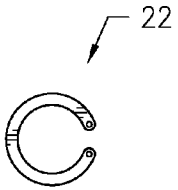
FIG. 5 is a top plan view of one of the snap rings of FIG. 2 shown removed from the cylinder.

Inside the hollow cylinder 12, the enhancer 10 is provided with a tightly packed core 18 constructed of copper wire. Referring also to FIGS. 4 and 5, the core 18 is held within the hollow cylinder 12 by a keeper 20 and snap ring 22 provided on each end 16 of the cylinder 12. Each keeper 20 is preferably constructed of a perforated copper disc. The cylinder 12 is provided internally with two circumferential grooves 24 located on each end 16 of the cylinder 12 into which the snap rings 22 secure to hold the keepers 20 against the opposite ends 26 of the core 18.

With the enhancer 10 installed in a fuel supply line, the fuel that flows through the fuel line must pass through the hollow cylinder 12 of the enhancer 10. The fuel flows through the perforations 28 in the keeper 20, then contacts the tightly packed copper wire core 18 before passing through the second keeper 20 and then out of the enhancer 10. The copper wire of the core 18 serves as a catalyst to break the longer chain molecules of the fuel into shorter molecules. The fuel pressure activates the copper catalyst to cause this catalytic cracking or breaking of the fuel molecules.

The large surface area of the copper wire core 18 causes better contact between the fuel and the catalyst, resulting in more fuel molecules being broken into shorter molecules. Breaking fuel molecules creates more total fuel molecules available for burning. This results in a fuel that has a higher vapor pressure and that burns more efficiently.

In addition to holding the copper wire core 18 in place within the cylinder 12, the copper keepers 20 also tend to filter the fuel and to enhance the catalytic process. The snap rings 22 can be removed from the cylinder 12 in order to remove and clean the copper keepers 20 of any debris that may enter the cylinder 12 from the fuel source.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A method of making a vapor pressure enhancer for installation in-line in a fuel line that supplies fuel to fuel usage equipment comprising:

seating a first snap ring in a first circumferential groove provided internally within a first male threaded end of a hollow cylinder, inserting a first perforated copper keeper disc into the hollow cylinder via the opposite second male threaded end of the cylinder, inserting a core of tightly packed copper wire into the hollow cylinder via the second male threaded end of the cylinder, inserting a second perforated copper keeper disc into the hollow cylinder via the second male threaded end of the cylinder, and seating a second snap ring in a second circumferential groove provided internally within the second male threaded end of the hollow cylinder.

* * * * *